US011098417B2

(12) United States Patent
Xu et al.

(10) Patent No.: US 11,098,417 B2
(45) Date of Patent: Aug. 24, 2021

(54) YARN TWISTING METHOD AND DEVICE FOR RING-SPINNING MACHINE

(71) Applicant: The Hong Kong Research Institute of Textiles and Apparel Limited, Kowloon (HK)

(72) Inventors: Bingang Xu, Kowloon (HK); Jie Feng, Kowloon (HK)

(73) Assignee: The Hong Kong Research Institute of Textiles and Apparel Limited, The Hong Kong Polytechnic University, Hong Kong (HK)

( * ) Notice: Subject to any disclaimer, the term of this patent is extended or adjusted under 35 U.S.C. 154(b) by 99 days.

(21) Appl. No.: 16/465,478

(22) PCT Filed: Feb. 22, 2017

(86) PCT No.: PCT/CN2017/074326
§ 371 (c)(1),
(2) Date: May 30, 2019

(87) PCT Pub. No.: WO2018/148976
PCT Pub. Date: Aug. 23, 2018

(65) Prior Publication Data

US 2021/0079565 A1 Mar. 18, 2021

(30) Foreign Application Priority Data

Feb. 17, 2017 (CN) ..... 201710085192.4

(51) Int. Cl.
*D01H 5/74* (2006.01)
*D01H 7/52* (2006.01)

(52) U.S. Cl.
CPC ..... *D01H 5/74* (2013.01); *D01H 7/52* (2013.01)

(58) Field of Classification Search
CPC .. D01H 5/74; D01H 5/72; D01H 5/22; D01H 5/44; D01H 5/70; D01H 7/52; D01H 1/22; D01H 1/24; D01H 13/02; D01H 13/04
See application file for complete search history.

(56) References Cited

U.S. PATENT DOCUMENTS 2,025,394 A * 12/1935 Langen ..... D01H 13/04 19/252
2,156,244 A * 4/1939 Mahoney ..... D01H 13/30 57/309

(Continued)

FOREIGN PATENT DOCUMENTS

CN 1143986 A 2/1997
CN 1853008 A 10/2006

(Continued)

OTHER PUBLICATIONS

English translation of DE2544644 to Klose, obtained via espacenet.com (last visited Jan. 14, 2021). (Year: 2021).*

(Continued)

*Primary Examiner* — Shaun R Hurley
*Assistant Examiner* — Patrick J. Lynch
(74) *Attorney, Agent, or Firm* — Barlow, Josephs & Holmes, Ltd.

(57) ABSTRACT

A yarn twisting method and device for a ring spinning machine is provided. The twisting method comprises the following steps: feeding three roving strands (1, 2, 3) into a back roller (8) of the ring spinning machine; after drafting, the three roving strands, three fiber strands (1, 2, 3) exiting from a nip point of a front roller (10), wherein a fiber strand (2) in the middle forms an angle with a plane formed by the other two fiber strands (1, 3), and thus the three fiber strands (1, 2, 3) form a multi-strand spinning triangle region having a three-dimensional spatial form; and in the multi-strand (Continued)

spinning triangle region, the three fiber strands (1, 2, 3) obtaining twist by means of a ring traveler of the ring spinning machine, and the twisted fiber strands (1 ,2, 3) are combined into a composite yarn (4) through a convergence point.

8 Claims, 6 Drawing Sheets

(56) References Cited

U.S. PATENT DOCUMENTS

| | | | | | |
|---|---|---|---|---|---|
| 3,031,724 | A * | 5/1962 | Butler | D01H 5/26 | 19/250 |
| 3,599,416 | A * | 8/1971 | Reuter | D02G 3/281 | 57/315 |
| 4,470,253 | A * | 9/1984 | Schulz | D02G 3/281 | 19/243 |
| 4,711,080 | A * | 12/1987 | Shibazaki | D01H 1/115 | 57/12 |
| 4,825,633 | A * | 5/1989 | Artzt | D01H 1/115 | 57/328 |
| 4,922,701 | A * | 5/1990 | Sawhney | D02G 3/367 | 57/12 |
| 5,170,619 | A * | 12/1992 | Noda | D01H 1/115 | 57/328 |
| 5,531,063 | A * | 7/1996 | Sawhney | D01H 13/04 | 19/244 |
| 5,577,298 | A * | 11/1996 | Morell | D01H 5/00 | 19/288 |
| 6,170,125 | B1 * | 1/2001 | Steinert | D01H 5/005 | 19/150 |
| 6,295,699 | B1 * | 10/2001 | Temburg | D01G 15/64 | 19/157 |
| 6,460,322 | B1 * | 10/2002 | Sato | D02G 3/324 | 57/225 |
| 7,155,891 | B2 * | 1/2007 | Bader | D02G 3/367 | 57/210 |
| 2004/0194257 | A1 * | 10/2004 | Dammig | D01H 5/38 | 19/236 |
| 2005/0076476 | A1 * | 4/2005 | Temburg | D01H 5/005 | 19/236 |
| 2009/0007538 | A1 * | 1/2009 | Cheng | D02G 3/26 | 57/282 |
| 2020/0173061 | A1 * | 6/2020 | Kaminszky | D01H 5/72 | |

FOREIGN PATENT DOCUMENTS

| | | | | |
|---|---|---|---|---|
| CN | 101476186 | B | 11/2010 | |
| CN | 102828308 | A | 12/2012 | |
| CN | 203212719 | U | 9/2013 | |
| CN | 103556320 | A | 2/2014 | |
| CN | 105671702 | A | 6/2016 | |
| DE | 2544644 | A1 * | 4/1977 | D01H 13/04 |
| DE | 19619307 | B2 | 4/2010 | |
| JP | 06184835 | A | 7/1994 | |
| JP | 2006083476 | A | 3/2006 | |
| JP | 3967622 | B2 | 6/2007 | |
| WO | 9514800 | A1 | 6/1995 | |
| WO | 9521953 | A1 | 8/1995 | |
| WO | 2018148976 | A1 | 8/2018 | |

OTHER PUBLICATIONS

Matsumoto, M. et al., "Construction of twin staple-core spun yarn with two points of yarn formation in one twisting process", Textile Research Journal, 2014, col. 84(17) 1858-1866.

Matsumoto, Y. et al., "Exploratory Work on the Spinning Condition of the Structure of Staple-core Twin-spun Yams", Textile Research Journal, 2010, vol. 80(11): 1056-1064.

Matsumoto, Y. et al., "Characteristics of Novel Triplet Spun Yarns Made from Fibers of Differing Fineness", Textile Research Journal, 2009, vol. 79(10): 947-952.

* cited by examiner

YARN TWISTING METHOD AND DEVICE FOR RING-SPINNING MACHINE

TECHNICAL FIELD

The present disclosure relates to the field of spinning technology, and more particularly to a yarn twisting method and apparatus for a ring spinning machine.

BACKGROUND ART

At present, the traditional ring spinning method is the main production method for spun yarn. The spinning triangle region formed at a nip point of a front roller is a key region for the traditional ring spinning, the shape change of which directly affects the yarn structure and the yarn forming performance. In recent years, many new spinning methods have changed the internal structure of the yarn by changing the triangle region, so as to improve the yarn performance. The compact spinning method reduces yarn hairiness, increases strength and improves yarn evenness by reducing or eliminating the spinning triangle region; the Siro spinning method makes the yarn of a folded yarn-like structure with high strength, low hairiness and good yarn evenness by feeding double roving; and the Solo spinning method makes the yarn of a structure of multiple strands composite yarn by dividing one roving into a plurality of smaller strands, thus making the yarn with high strength and low hairiness.

There are also some new spinning methods that change the shape of a traditional triangle region mainly by feeding three roving strands to obtain different yarn structures and improve yarn forming performance. For example, in "Textile Research Journal" vol. 79, no. 10, 2009, vol. 80, no. 11, 2010 and vol. 84, no. 17, 2014, Yo-ichi Matsumoto et al. proposed that the feeding of the three roving strands makes the shape of the spinning triangle region different from the traditional triangle region, thereby changing the structure of the yarn and improving the yarn forming performance. It is found in the search that the patents involving the feeding of three roving strands cover the following three aspects: the first main purpose is the blending of different fiber raw materials, such as "Device and method for realizing blending and color mixing based on triple-roving coupling drafting and twisting system" of the patent publication No. CN 103556320 A, which focuses on achieving the uniform yarn blending and blending of mixed color yarn with different raw materials and proportions on the ring spinning machine. The second main purpose is to introduce filament yarn while feeding three rovings to spin different core yarn products, such as "Compact core yarn apparatus capable of feeding three roving s by drafting of four rollers" of the patent publication number CN 203212719 U. The third main purpose is to increase the strength of a single yarn by means of doubling yarn, such as the "Compact Spinning method" of the patent publication No. CN 101476186 B, which focuses on obtaining high strength by achieving convergence of three yarn strands on a compact spinning apparatus. However, in the spinning method involving three rovings of the above three aspects, the spinning triangles at the nip point of the front roller are all in the form of a two-dimensional plane, and do not involve a spinning triangle region having a three-dimensional form, while the present disclosure adopts a spinning technique involving a non-planar spinning triangle, and provides a corresponding spinning method. The yarn processed through this method has the characteristics of high strength, less hairiness and good yarn evenness.

Accordingly the present disclosure may provides a yarn twisting method and apparatus for a ring spinning machine to improve single yarn performance index, apply short fiber spinning, and achieve industrialized yarn production.

SUMMARY

In one aspect, the present disclosure provides a yarn twisting method for a ring spinning machine, and the method comprises:

feeding three roving strands into a back roller of the ring spinning machine;

after drafting the three roving strands, three fiber strands output/exiting from a nip point of a front roller, wherein a fiber strand in the middle forms an angle with a plane formed by the other two fiber strands, and thus such three fiber strands forming a multi-strand spinning triangle region having a three-dimensional spatial form; and in the multi-strand spinning triangle region, the three fiber strands obtaining twist by means of a ring traveller of the ring spinning machine, and the twisted fiber strands combined into a composite yarn through a convergence point.

Preferably, the three roving strands may be simultaneously fed into the back roller in parallel.

Preferably, the method may further comprise:

after feeding the three roving stands into the back roller and before exiting the front roller, locating the three roving strands are located in fixed positions by a roving splitter mechanism installed between the back roller and a middle roller.

Preferably, the angle may range from 0 degree to 45 degrees.

Preferably, when the angle is 0 degree, the fiber strand output in the middle and the fiber strands output at the two sides may be in the same plane, and after feeding the three roving stands into the back roller, the method may further comprise:

converging edge fibers of the fiber strands by a spun yarn converging mechanism installed between the middle roller and the front roller.

Preferably, when the angle is greater than 0 degree, the three fiber strands form a multi-strand spinning triangle region having a three-dimensional spatial form, and the fiber strand output in the middle and the fiber strands output at the two sides may be not in the same plane, and after feeding the three roving stands into the back roller, the method may further comprise:

lifting the fiber strand in the middle by a multi-strand twisting mechanism installed at the nip point of the front roller.

Accordingly, the present disclosure further provides a yarn twisting apparatus of a ring spinning machine, comprising a back roller, a middle roller and a front roller, with three roving strands fed into the back roller in parallel; after drafting the three roving strands, three fiber strands may be exiting from a nip point of the front roller, and a fiber strand in the middle forms an angle with a plane formed by the other two fiber strands, and the three fiber strands form a multi-strand spinning triangle region having a three-dimensional spatial form; and in the multi-strand spinning triangle region, the three fiber strands obtain twist by means of a ring traveller of the ring spinning machine, and the twisted fiber strands are combined into a composite yarn through a convergence point.

Preferably, the apparatus may further comprise a roving splitter mechanism installed between the back roller and the middle roller for locating the three roving strands in fixed positions; and the roving splitter mechanism may consist of three cylinders with smooth surfaces, with the position of each cylinder being adjustable so as to locate each roving strand in a corresponding position.

Preferably, the apparatus may further comprise a spun yarn converging mechanism installed between the middle roller and the front roller for converging edge fibers of the fiber strands, and the fiber strand output in the middle and the fiber strands output at the two sides may be in the same plane, and the angle θ may be 0 degree; and the spun yarn converging mechanism may have convergence holes with different widths thereon, and the contacting surface of the convergence holes with the fiber strands may be smooth such that the edge fibers can be controlled continuously and smoothly.

Preferably, the apparatus may further comprise a multi-strand twisting mechanism installed at the nip point of the front roller for lifting the fiber strand in the middle, and the fiber strand output in the middle and the fiber strands output at the two sides may be not in the same plane, and the angle formed may be larger than 0 degree and less than or equal to 45 degrees.

Implementing the embodiments of the present disclosure has the following beneficial effects: the yarn twisting method and apparatus for a ring spinning machine provided in the present disclosure forms a spinning triangle region having a three-dimensional spatial form by means of a multi-strand twisting mechanism, such that each fiber strand has uniform twisting effect, thereby improving single yarn performance; in addition, using a spun yarn converging mechanism improves the control of edge fibers in the triangle region, thus further reducing yarn hairiness and improving yarn evenness.

BRIEF DESCRIPTION OF THE DRAWINGS

In order to more clearly illustrate the embodiments of the present disclosure or the technical solutions in the prior art, the drawings used in the embodiments or the prior art description will be briefly described below, and obviously, the drawings in the following description are only some embodiments of the present disclosure, and for those skilled in the art, other drawings can be obtained according to these drawings without any inventive effort.

Description of the reference number in drawings: 1. roving strand; 2. roving strand; 3. roving strand; 4. yarn; 5. roving positioner; 6. roving positioner; 7. roving positioner; 8. back roller; 9. middle roller; 10. front roller; 11. multi-strand twisting mechanism; 12. spun yarn convergence hole; 13. spun yarn convergence hole; 100. roving splitter mechanism; 200. spun yarn converging mechanism.

DETAILED DESCRIPTION OF EMBODIMENTS

The technical solutions in the embodiments of the present disclosure described in the following with reference to the drawings in the embodiments of the present disclosure.

Embodiment 1

Figure 1:
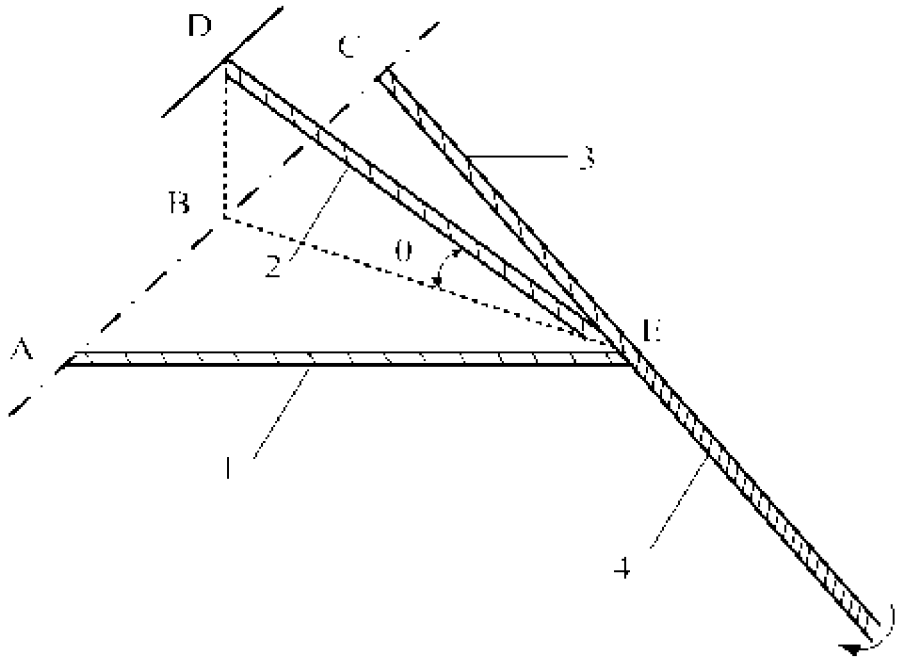
FIG. 1 is a schematic diagram of a spinning method according to the present disclosure.
Figure 2:
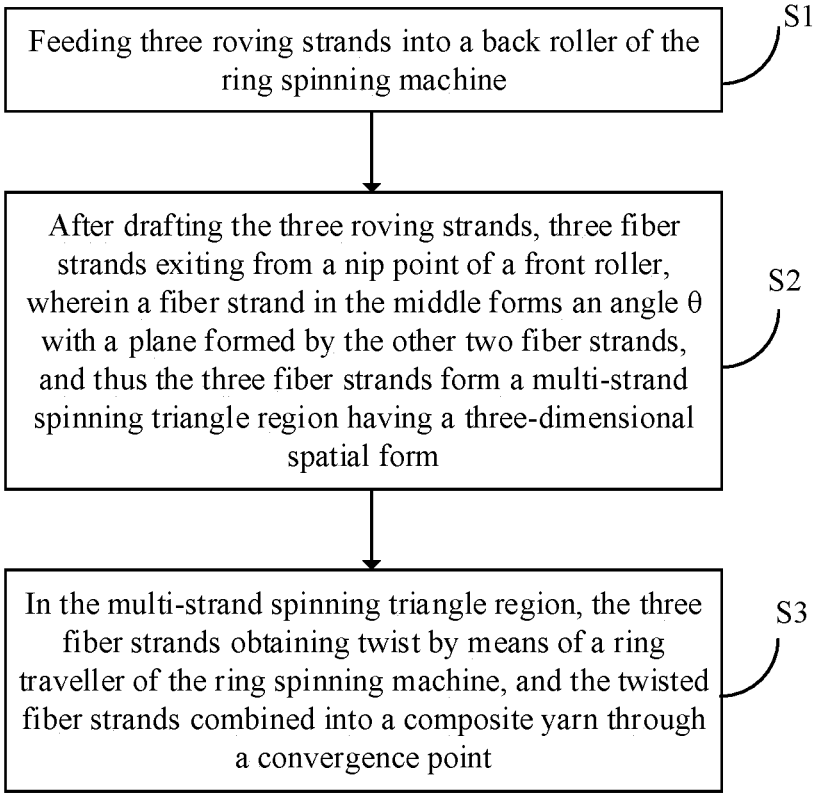
FIG. 2 is a flow chart of a yarn twisting method for a ring spinning machine according to a first embodiment of the present disclosure.

This embodiment provides a yarn twisting method for a ring spinning machine. FIG. 1 is a schematic diagram of a spinning method according to the present disclosure; FIG. 2 is a flow chart of a yarn twisting method for a ring spinning machine according to a first embodiment of the present disclosure. Referring to FIG. 2, the yarn twisting method for a ring spinning machine comprises the following steps:

Step S1: Feeding three roving strands into a back roller of the ring spinning machine;

Specifically, in this step, three roving strands are fed into the back roller of the ring spinning machine in parallel, with the three roving strands keeping spaced from each other at a certain distance.

Step S2: after drafting the three roving strands, three fiber strands exiting/output from a nip point of a front roller, wherein a fiber strand in the middle forms an angle with a plane formed by the other two fiber strands, and the three fiber strands form a multi-strand spinning triangle region having a three-dimensional spatial form; and Step S3: in the multi-strand spinning triangle region, the three fiber strands obtaining twist by means of a ring traveller of the ring spinning machine, and the twisted fiber strands combined into a composite yarn through a convergence point.

As shown in FIG. 1, three roving strands 1, 2 and 3 are coming out/exiting at the nip point of the front rollers after drafting, wherein the middle fiber strand 2 forms an angle θ with a plane formed by the other two fiber strands 1 and 3, thus a multi-strand spinning triangle region having three-dimensional spatial form is formed. In the spinning triangle region, the ends A, D and C of the three fiber strands are held at the nip point of the front rollers, and the three fiber strands 1, 2 and 3 obtain twist by means of a ring traveller, and the twisted fiber strands are combined into a novel composite yarn through a convergence point E. The angle θ may be any angle between 0 degree and 45 degrees, and when the angle θ is 0 degree, the three fiber strands in the spinning triangle region are in the same plane, and the planar spinning triangle region is a special case of the three-dimensional spatial spinning triangle region; and when the angle θ is greater than 0 degree, the three fiber strands in the spinning triangle region are not in the same plane, thereby forming a spinning triangle region having a three-dimensional spatial form.

Embodiment 2

Figure 3:
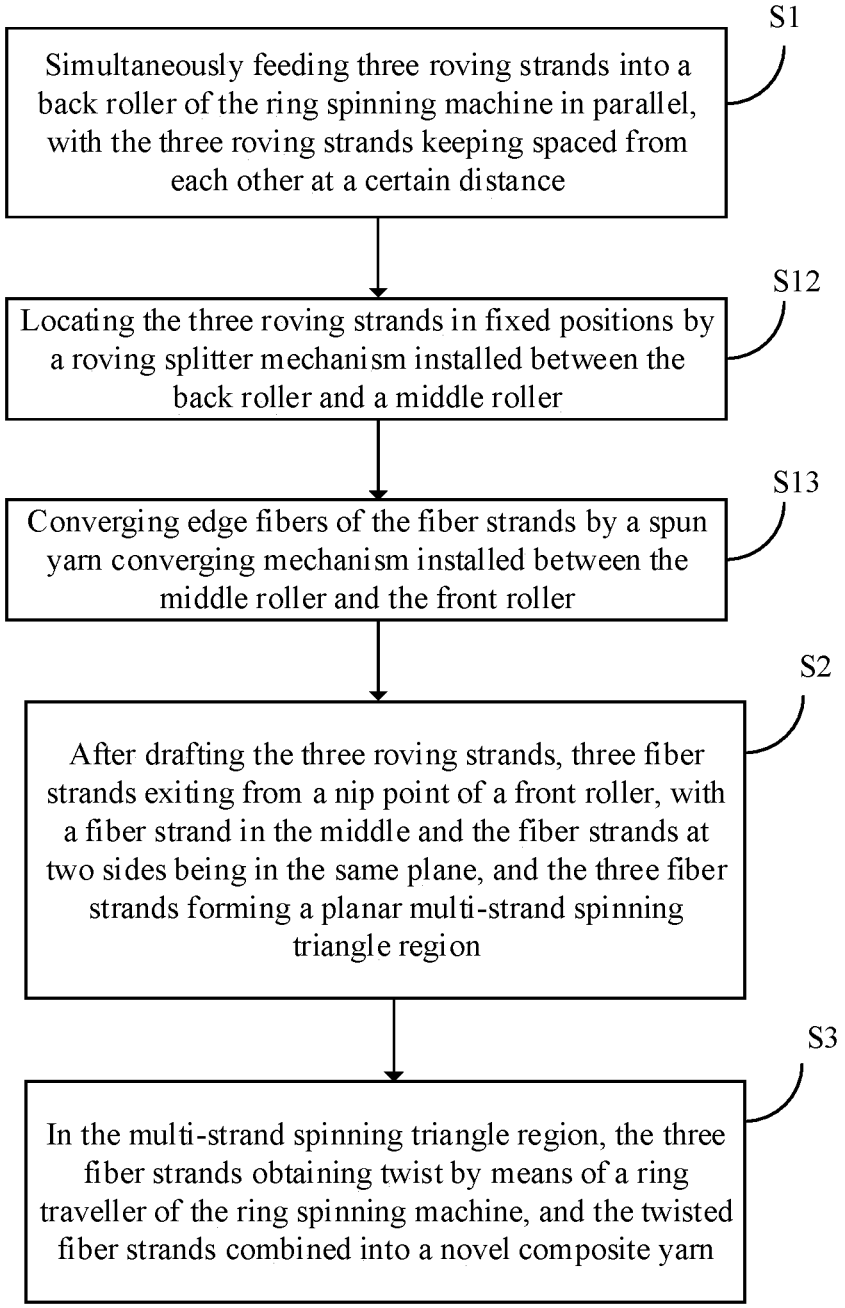
FIG. 3 is a flow chart of a yarn twisting method for a ring spinning machine according to a second embodiment of the present disclosure.
Figure 4:
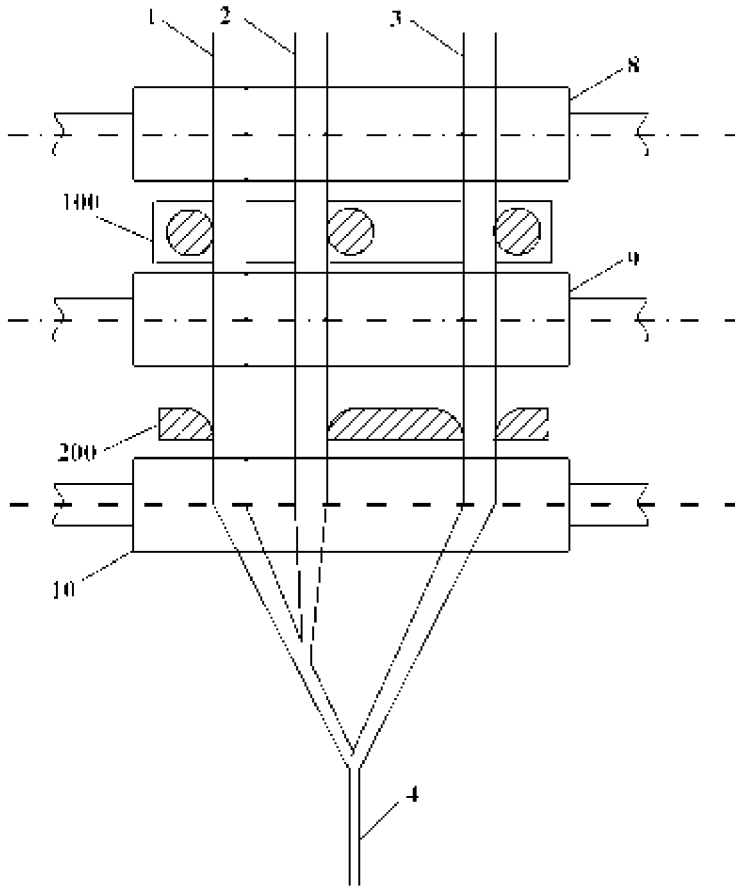
FIG. 4 is a twisting process diagram of a yarn twisting method for a ring spinning machine according to a second embodiment of the present disclosure.

This embodiment provides a yarn twisting method for a ring spinning machine. FIG. 3 is a flow chart of a yarn twisting method for a ring spinning machine according to a second embodiment of the present disclosure; and FIG. 4 is a twisting process diagram of a yarn twisting method for a ring spinning machine according to a second embodiment of the present disclosure. Referring to FIG. 3, the yarn twisting method for a ring spinning machine comprises the following steps:

Step S1, simultaneously feeding three roving strands into a back roller in parallel, with the three roving strands keeping spaced from each other at a certain distance; and Step S12: locating the three roving strands in fixed positions by a roving splitter mechanism installed between the back roller and a middle roller; and specifically, in this step, the distance between the roving strand output in the middle and the roving strands output at two sides may be the same or different.

Step S13: converging edge fibers of the fiber strands by a spun yarn converging mechanism installed between the middle roller and the front roller.

Step S2: after drafting the three roving strands, three fiber strands are coming out/exiting from a nip point of the front roller , with a fiber strand in the middle and the fiber strands at two sides being in the same plane, and the three fiber strands forming a planar multi-strand spinning triangle region; and Step S3: in the multi-strand spinning triangle region, the three fiber strands obtaining twist by means of a ring traveller of the ring spinning machine, and the twisted fiber strands being combined into a novel composite yarn.

In the present embodiment, three roving strands 1, 2 and 3 are fed in parallel into the back roller 8 of the ring spinning machine, and each roving will be positioned by a roving splitter mechanism 100 installed between the back roller 8 and the middle roller 9. Roving strand positioners 5 and 7 separate the roving 1 and the roving 3 by a certain distance, and the roving strand positioner 6 locates the roving 2 at a position close to the roving 1. And a spun yarn converging mechanism 200 installed between the middle roller 9 and the front roller 10 will converge edge fibers of the fiber strands, and when the drafted fiber strands is coming out from the nip of the front roller 10, the three fiber strands are in the same plane. It can be seen that the fiber strand 1 is first converged with the fiber strand 2 and then converged again with the fiber strand 3 to form a composite yarn 4.

Figure 5:
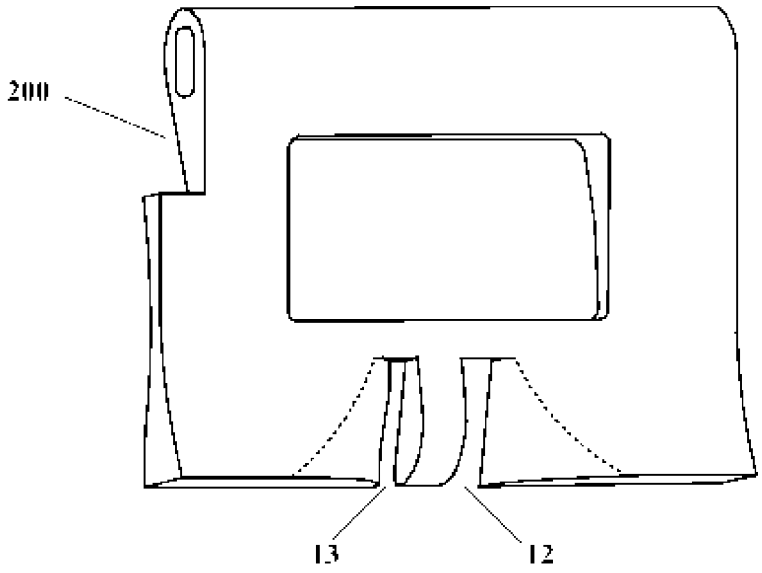
FIG. 5 is a structure diagram of a spun yarn converging structure.

FIG. 5 shows a specific structure of a spun yarn converging mechanism 200. The spun yarn converging mechanism 200 has two spun yarn convergence holes 12 and 13, and the convergence hole 12 will converge the edge fibers of the fiber strands 1 and 2, and the convergence hole 13 will separately converge the edge fibers of the fiber strand 3. In this case, the width of the convergence holes is determined by the width of the fiber strands itself and the distance between the strands, and therefore, in the spinning process shown in FIG. 4, the designed width of the convergence hole 12 is larger than the width of the convergence hole 13, and inversely, if the fiber strand 2 is located near the fiber strand 3, the designed width of the convergence hole 13 should be larger than the width of the convergence hole 12. The surfaces of the two convergence holes are smooth, and the part contacting with the fiber strands presents a certain degree of curvature, which can facilitate the control of the edge fibers of the triangle region, thereby further reducing the yarn hairiness and improving the yarn evenness.

Embodiment 3

Figure 6:
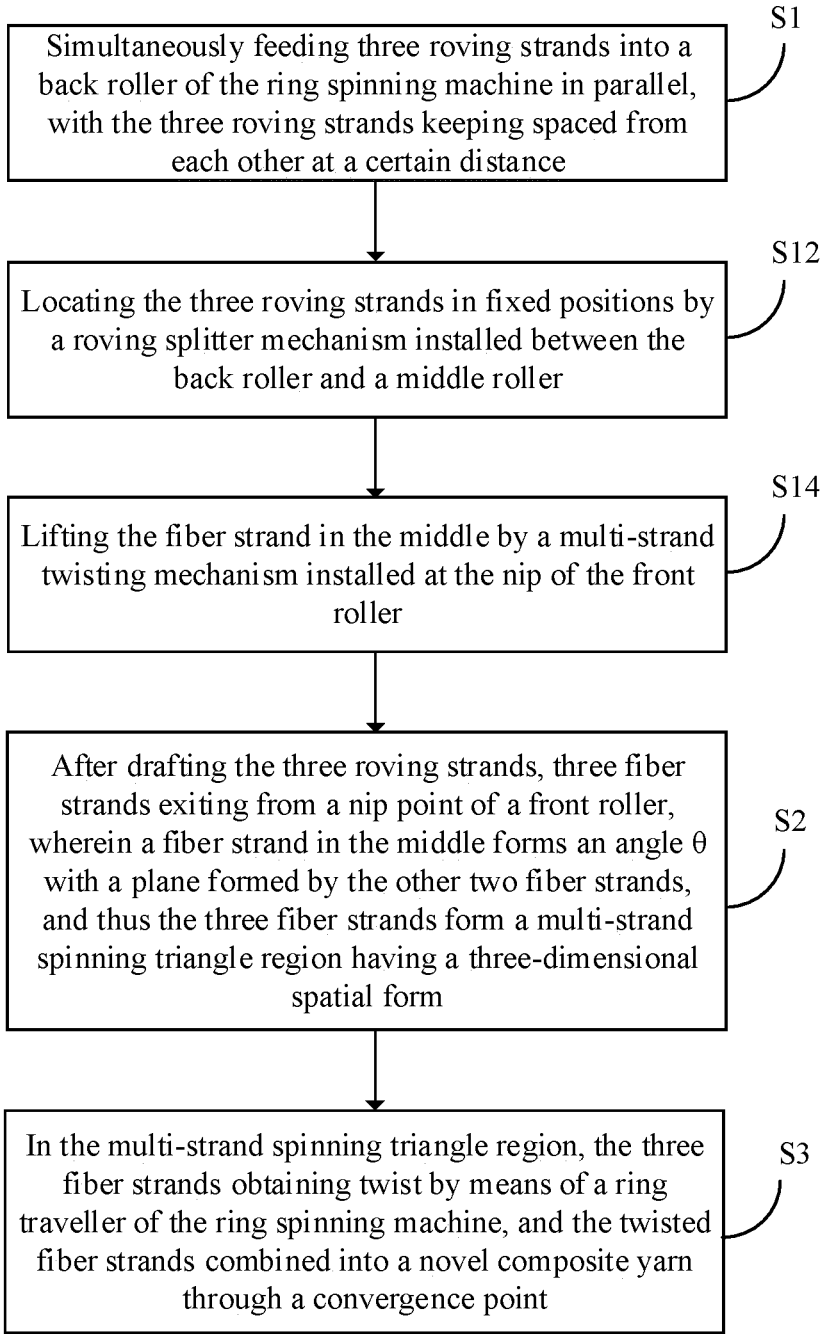
FIG. 6 is a flow chart of a yarn twisting method for a ring spinning machine according to a third embodiment of the present disclosure.
Figure 7:
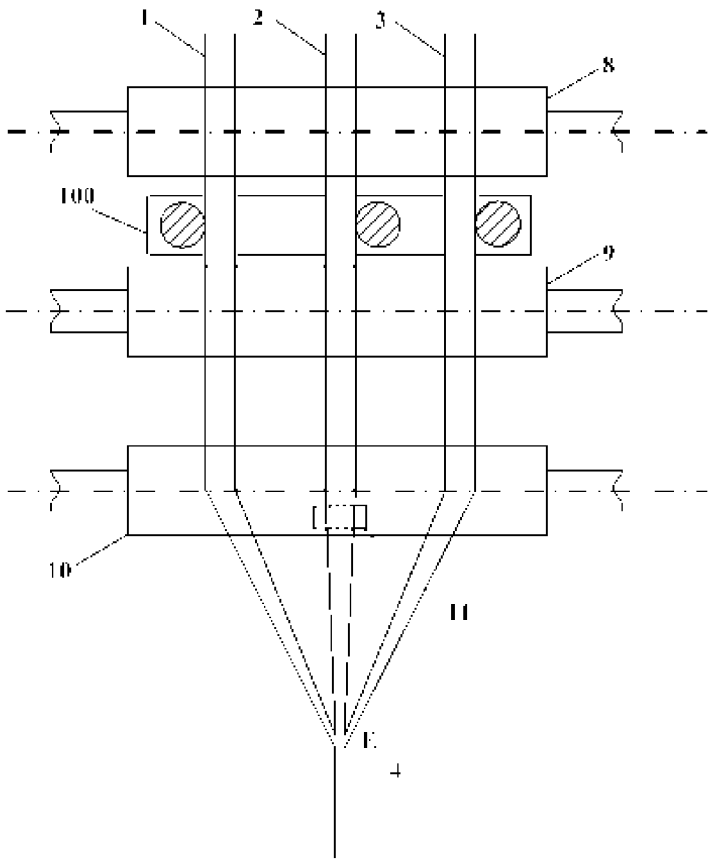
FIG. 7 is a twisting process diagram of a yarn twisting method for a ring spinning machine according to a third embodiment of the present disclosure.

This embodiment provides a yarn twisting method for a ring spinning machine. FIG. 6 is a flow chart of a yarn twisting method for a ring spinning machine according to a third embodiment of the present disclosure; and FIG. 7 is a twisting process diagram of a yarn twisting method for a ring spinning machine according to a third embodiment of the present disclosure. Referring to FIG. 6, the yarn twisting method for a ring spinning machine comprises the following steps:

Step S1: simultaneously feeding three roving strands into a back roller in parallel, with the three roving strands keeping spaced from each other at a certain distance; and Step S12: Locating the three roving strands in fixed positions by a roving splitter mechanism installed between the back roller and a middle roller, and specifically, in this step, the distance between the roving strand output in the middle and the roving strands output at two sides may be the same or different.

Step S14: lifting the fiber strand in the middle by a multi-strand twisting mechanism installed at the nip of the front roller.

Step S2: after drafting the three roving strands, three fiber strands are coming out/exiting from the nip point of the front roller, with a fiber strand in the middle forming an angle with a plane formed by the other two fiber strands, and the three fiber strands forming a multi-strand spinning triangle region having a three-dimensional spatial form; and Step S3: in the multi-strand spinning triangle region, the three fiber strands obtaining twist by means of a ring traveller of the ring spinning machine, and the twisted fiber strands being combined into a novel composite yarn through a convergence point.

FIG. 7 is a specific spinning process. In the present embodiment, three roving strands 1, 2 and 3 are fed in parallel into the back roller 8 of the ring spinning machine, and a roving splitter mechanism 100 installed between the back roller 8 and the middle roller 9 will locate each roving in a fixed position, so as to keep a certain distance between roving 1 and 3, while roving 2 can be placed at anywhere between the roving 1 and 3. When the three drafted fiber strands are coming out/exiting from the nip point of the front roller 10, a multi-strand twisting mechanism 11 is placed near the nip point of the front roller 10 of the ring spinning machine for lifting the fiber strand 2 in the middle, and therefore, there will be a non-planar relationship between the three fiber strands, thus forming a special spatial spinning triangle region. The twist delivered from the ring traveller is delivered to the fiber strands through the convergence point E of the strands, and the twisted fiber strands form a three-dimensional composite yarn 4 through the convergence point.

Figure 8:
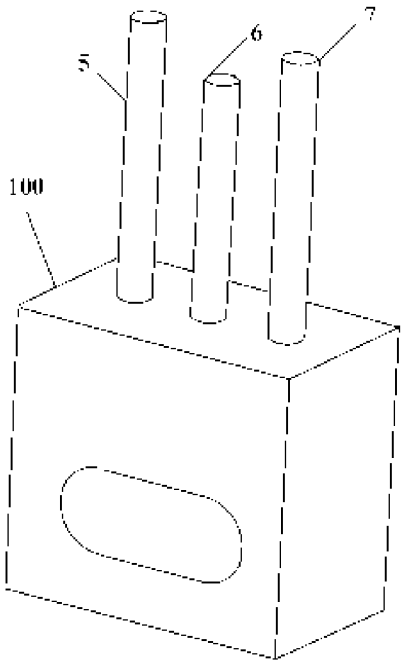
FIG. 8 is a specific structure of the roving splitter mechanism 100.

FIG. 8 is a specific structure of the roving splitter mechanism 100. The roving splitter mechanism 100 has three cylindrical roving strand positioners 5, 6 and 7 with smooth surfaces, and the roving strand positioners 5 and 7 cause the roving 1 and the roving 3 to be separated by a certain distance, and the roving strand positioner 6 makes the roving strand 2 located at any position between the roving strand 1 and the roving strand 3.

Figure 9:
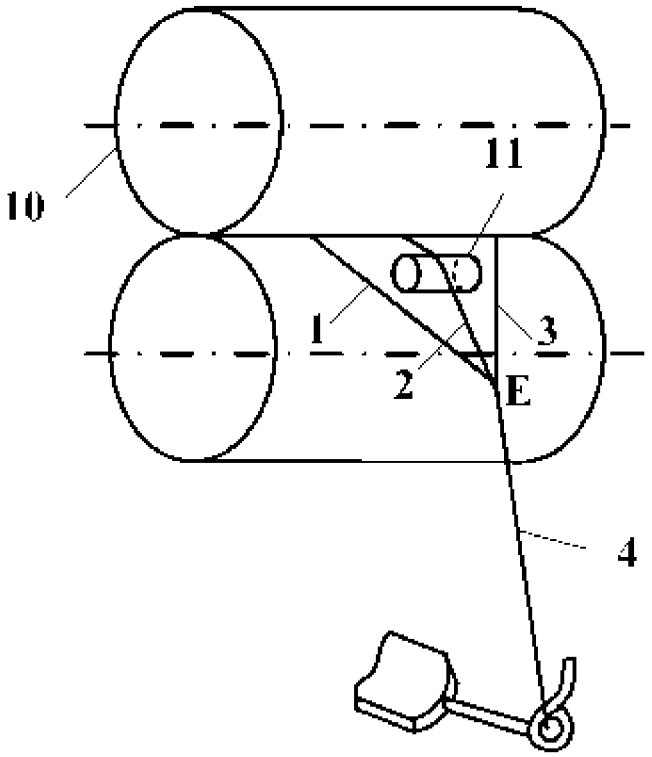
FIG. 9 is an enlarged diagram of the nip point of the front roller in the spinning process in FIG. 7.

FIG. 9 is an enlarged diagram of the nip point of the front roller in the spinning process in FIG. 7: the three fiber strands are coming out/exiting from the nip of the front roller 10, and the middle fiber strand 2 is lifted by the multi-strand twisting mechanism 11 to a certain height, thus forming an angle with the plane formed by the other two fiber strands 1 and 3, and the spinning triangle region formed by the three fiber strands is not in a plane, but forms a three-dimensional shape. A spinning triangle region having such a three-dimensional shape will enable each fiber strand to obtain a uniform twisting effect, thereby improving single yarn performance. In the above spinning method, when the roving strand positioner 6 can locate the roving strand 2 at a position between the roving strand 1 and the roving strand 3, the three fiber threads have only one convergence point, and are twisted at this point to form a composite yarn.

Preferably, after the step S12 and before the step S14, the method further comprises:

Converging edge fibers of the fiber threads by a spun yarn converging mechanism installed between the middle roller and the front roller to reduce the yarn hairiness and improve the yarn evenness.

Accordingly, the yarn twisting apparatus for the ring spinning machine further comprises a spun yarn converging mechanism (not shown in FIG. 7). FIG. 5 shows a specific structure of a spun yarn converging mechanism 200. The spun yarn converging mechanism 200 has two spun yarn convergence holes 12 and 13, and the convergence hole 12 will converge the edge fibers of the fiber strands 1 and 2, and the convergence hole 13 will separately converge the edge fibers of the fiber strand 3, in such case, the width of the convergence holes is determined by the width of the fiber strands itself and the distance between the strands, and therefore, in the spinning process shown in FIG. 4, the designed width of the convergence hole 12 is larger than the width of the convergence hole 13, and inversely, if the fiber strand 2 is located near the fiber strand 3, the designed width of the convergence hole 13 should be larger than the width of the convergence hole 12. The surfaces of the two convergence holes are smooth, and the part contacting with the fiber strands presents a certain degree of curvature, which can facilitate the control of the edge fibers of the triangle region, thereby further reducing the yarn hairiness and improving the yarn evenness.

The above spinning methods were all achieved and tested in the laboratory Zinser-351 ring spinning machine, and satisfactory results were obtained.

For the spinning method provided in the embodiment 3, the raw material used in the experiment was 100% silk fiber, and the roving count was 369 tex. The ring spinning machine has a spindle speed of 13,000 r/min, a yarn count of 19.7 tex, and a yarn twist of 18.1 T/in. The spinning process adopted in the laboratory is shown in FIG. 7: the distance between the fiber strands 1 and 3 for spinning is 12 mm, the fiber strand 2 located at the middle position of the fiber strands 1 and 3, and the angle θ formed between the fiber strand 2 and the plane formed by fiber strands 1 and 3 is 15 degrees. After placing the produced novel silk yarn in a standard laboratory (20±2° C. and 65±2% RH) for at least 24 hours, the yarn performance data tested are listed in Table 1. Meanwhile, in order to compare the effects of the spinning method of the present disclosure, the performance data of common ring spinning silk yarn are also listed in Table 1, as comparative data.

TABLE 1

| | Single yarn strength (cN) | Yarn evenness CVm (%) | −50% thin places (/km) | +50% thick places (/km) | +200% neps (/km) | Hairiness (S3/100 m) |
|---|---|---|---|---|---|---|
| Common method | 487.1 | 11.26 | 0 | 13 | 16 | 849 |
| Method according to the present disclosure | 517.2 | 10.03 | 8 | 12 | 22 | 238 |

For the spinning method provided in the embodiment 2, the raw material used in the experiment was 100% yak hair fiber, and the roving count was 250 tex. The ring spinning machine has a spindle speed of 9,500 r/min, a yarn count of 48 Nm, and a yarn twist of 20.2 T/in. The spinning process adopted in the laboratory is as shown in FIG. 4: the angle θ between the fiber strand 2 and the plane formed by the fiber strands 1 and 3 is 0 degree, and the distances between the fiber strand 2 and the fiber strand 1 or the fiber strand 3 are 0 mm and 2 mm, respectively, the width of the convergence hole 12 is 2 mm, and the width of the convergence hole 13 is 1 mm. After placing the produced novel yak yarn in a standard laboratory (20±2° C. and 65±2% RH) for at least 24 hours, the yarn performance data tested are listed in Table 1. Meanwhile, in order to compare the effects of the spinning method of the present disclosure, the performance data of common ring spinning yak hair yarn are also listed in Table 2, as comparative data. The spinning process parameters and yarn forming quality index are shown in the following table:

TABLE 2

| | Single yarn tenacity (cN/tex) | yarn evenness CVm (%) | −50% thin places (/km) | +50% thick places (/km) | +200% neps (/km) | Hairiness (S3/100 m) |
|---|---|---|---|---|---|---|
| Common method | 4.57 | 17.95 | 161 | 92 | 247 | 2662 |
| Method according to the present disclosure | 5.57 | 17.62 | 203 | 105 | 170 | 1347 |

The above is only a preferred embodiment of the present disclosure, and of course, the scope of the present disclosure is not limited thereto. Those skilled in the art can understand that all or part of the process of implementing the above embodiment and equivalent changes made according to the claims of the present disclosure still fall within the scope of the disclosure.

The invention claimed is:

1. A yarn twisting method for a ring spinning machine, comprising:

feeding three roving strands into a back roller of the ring spinning machine and drafting the three roving strands into three fiber strands;

lifting a middle fiber strand of the three fiber strands by a multi-strand twisting mechanism installed at a nip point of a front roller, so that for the three fiber strands exiting from the nip point of the front roller the middle fiber strand forms an angle θ greater than zero degrees with a plane formed by the other two fiber strands, and thereby the three fiber strands form a multi-strand spinning triangle region having a three-dimensional spatial form; and in the multi-strand spinning triangle region, the three fiber strands obtaining twist by means of a ring traveller of the ring spinning machine thereby forming twisted fiber strands, and the twisted fiber strands combined into a composite yarn through a convergence point.

2. The yarn twisting method for a ring spinning machine according to claim 1, characterized in that the three roving strands are simultaneously fed into the back roller in parallel.

3. The yarn twisting method for a ring spinning machine according to claim 1, characterized in that the method further comprises:

after feeding the three roving strands into the back roller and before exiting the front roller, the three roving strands are located in fixed positions by a roving splitter mechanism installed between the back roller and a middle roller.

4. The yarn twisting method for a ring spinning machine according to claim 1, wherein the angle θ is less than or equal to 45 degrees.

5. The yarn twisting method for a ring spinning machine according to claim 4, comprising:

converging edge fibers of the three fiber strands by a spun yarn converging mechanism installed between a middle roller and the front roller.

6. A yarn twisting apparatus for a ring spinning machine, comprising a back roller, a middle roller and a front roller, wherein three roving strands are fed into the back roller in parallel; after drafting the three roving strands into three fiber strands, the three fiber strands exit from a nip point of the front roller, wherein a middle fiber strand of the three fiber strands forms a first angle with a plane formed by the two other fiber strands, and thereby the three fiber strands form a multi-strand spinning triangle region having a three-dimensional spatial form; and in the multi-strand spinning triangle region, the three fiber strands obtain twist by means of a ring traveller of the ring spinning machine to form twisted fiber strands, and the twisted fiber strands are combined into a composite yarn through a convergence point, and wherein the yarn twisting apparatus further comprises a multi-strand twisting mechanism installed at the nip point of the front roller for lifting the middle fiber strand, such that the middle fiber strand and the two other fiber strands are not in the same plane, and the first angle formed is larger than 0 degrees and less than or equal to 45 degrees.

7. The yarn twisting apparatus for a ring spinning machine according to claim 6, further comprising a roving splitter mechanism installed between the back roller and the middle roller for locating the three roving strands in fixed positions; and the roving splitter mechanism consisting of three cylinders with smooth surfaces, with the position of each cylinder being adjustable so as to locate each roving strand in a corresponding position.

8. The yarn twisting apparatus for a ring spinning machine according to claim 6, further comprising a spun yarn converging mechanism installed between the middle roller and the front roller for converging edge fibers of the fiber strands, wherein the middle fiber strand and the fiber strands output at the two sides are in the same plane, and the middle fiber strand forms a second angle of 0 degrees with the plane formed by the two other fiber strands; and the spun yarn converging mechanism having convergence holes with different widths thereon, wherein a surface of the converging mechanism that bounds the convergence holes is smooth such that the edge fibers can be controlled continuously and smoothly.

* * * * *